US006488078B2

(12) United States Patent
Beutler et al.

(10) Patent No.: US 6,488,078 B2
(45) Date of Patent: Dec. 3, 2002

(54) HEAT-EXCHANGER TUBE STRUCTURED ON BOTH SIDES AND A METHOD FOR ITS MANUFACTURE

(75) Inventors: Andreas Beutler, Senden; Guenter Fetzer, Staig; Ronald Lutz, Blaubeuren; Gerhard Schuez, Voehringen; Andreas Schwitalla, Illerrieden, all of (DE)

(73) Assignee: Wieland-Werke AG, Ulm (DE)

( * ) Notice: Subject to any disclaimer, the term of this patent is extended or adjusted under 35 U.S.C. 154(b) by 0 days.

(21) Appl. No.: 09/740,358

(22) Filed: Dec. 19, 2000

(65) Prior Publication Data

US 2001/0006106 A1 Jul. 5, 2001

(30) Foreign Application Priority Data

Dec. 28, 1999 (DE) ..... 199 63 353

(51) Int. Cl.[7] ..... F28F 13/02; F28F 1/42
(52) U.S. Cl. ..... 165/133; 165/179; 165/184
(58) Field of Search ..... 165/133, 177, 165/179, 183, 184

(56) References Cited

U.S. PATENT DOCUMENTS

| | | | | |
|---|---|---|---|---|
| 2,241,209 A | * | 5/1941 | Lea | 165/184 X |
| 2,868,046 A | | 1/1959 | Greene | |
| 3,314,260 A | | 4/1967 | Habdas et al. | |
| 3,327,512 A | | 6/1967 | Novak et al. | |
| 3,383,893 A | | 5/1968 | Counts | |
| 3,481,394 A | | 12/1969 | Withers, Jr. | |
| 3,847,212 A | * | 11/1974 | Withers, Jr. et al. | 165/179 |
| 4,216,826 A | * | 8/1980 | Fujikake | 165/133 |
| 4,660,630 A | * | 4/1987 | Cunningham et al. | 165/133 |
| 4,690,211 A | * | 9/1987 | Kuwahara et al. | 165/184 X |
| 4,715,436 A | * | 12/1987 | Takahashi et al. | 165/133 |
| 4,796,693 A | * | 1/1989 | Kastner et al. | 165/133 |
| 5,203,404 A | * | 4/1993 | Chiang et al. | 165/133 |
| 5,697,430 A | | 12/1997 | Thors et al. | |
| 5,775,411 A | * | 7/1998 | Schuez et al. | 165/133 |
| 5,996,686 A | | 12/1999 | Thors et al. | 165/179 |
| 6,067,832 A | | 5/2000 | Brand et al. | |
| 6,098,420 A | * | 8/2000 | Furukawa et al. | 165/179 X |

FOREIGN PATENT DOCUMENTS

| | | | |
|---|---|---|---|
| DE | 23 03 172 | 8/1973 | |
| EP | 0 165 583 | 12/1985 | |
| EP | 0 701 100 | 3/1996 | |
| GB | 565027 | * 10/1944 | 165/179 |
| JP | 07-218037 | * 8/1995 | F28F/1/16 |

OTHER PUBLICATIONS

Standards of Tubular Exchanger Manufacturers Association New York, 1968—Figure 1 (2 pages).

* cited by examiner

*Primary Examiner*—Leonard Leo
(74) *Attorney, Agent, or Firm*—Flynn, Thiel, Boutell & Tanis, P.C.

(57) ABSTRACT

The invention relates to heat-exchanger tubes structured on both inner and outer sides with excellent heat-transfer characteristics, which have recesses on the outside and ribs with specific dimensions on the inside. The structuring tools utilized for the various method modifications are adjusted in such a manner that they are not only able to create aligned, continuous grooves and non-aligned, spaced apart recesses but also secondary structures. The heat-exchanger tubes provided preferably with smooth end sections and smooth intermediate sections are utilized in particular in shell and tube heat-exchangers.

15 Claims, 7 Drawing Sheets

HEAT-EXCHANGER TUBE STRUCTURED ON BOTH SIDES AND A METHOD FOR ITS MANUFACTURE

FIELD OF THE INVENTION

The invention relates to a heat-exchanger tube with optionally smooth ends, at least one structured section on the outside and inside of the tube and optionally smooth intermediate sections, whereby the outside diameter of the structured area is no greater than the outside diameter of the smooth ends or of the smooth intermediate areas.

This type of tube is usually identified as "double-enhanced tubes".

BACKGROUND OF THE INVENTION

Heat-exchanger tubes of the mentioned type are usually used in shell and tube heat-exchangers (see FIG. 1, Source: TEMA, Standards of Tubular Exchanger Manufacturers Association, New York, 1968). These heat exchangers are characterized by a plurality of tubes 30, which are arranged parallel to one another, and which at their ends are tightly connected to the tube sheets 31. Depending on the operating conditions and tube length, the tubes are supported by means of baffles 32. These baffles 32 are also utilized to direct the shellside fluid flow in specific directions. For example, water or a mixture of water and glycol flows in the tubes 30, whereby the flowing medium along the inside of the tubes is heated or cooled off.

In order to increase the heat-transfer performance of such heat exchangers, finned or structured tubes instead of smooth surfaced ones are utilized. It is hereby intended to enlarge the surface which is available for the heat transfer and to furthermore utilize effects of the surface tension. FIG. 2 illustrates schematically a structured heat-exchanger tube 30. It has several structured sections 2, which are confined by smooth, unstructured end sections 1*a* and smooth unstructured intermediate sections 1*b* .The tube 30 is usually tightly connected at the smooth end sections 1*a* to the tube sheets 31 through a rolling process. The tube 30 rests at the smooth intermediate sections 1*b* in the bores of the baffles 32. In order for the tube to be able to be moved into the tube sheets 31 and baffles 32 and to be able to be tightly connected to the tube sheets 31 or not to have too much clearance in the bores of the baffles 32, the outer diameter of the structured sections 2 may not be greater than the outer diameter of the smooth sections 1*a* and 1*b* .On the other hand, the inside diameter of the tube 30 should be as large as possible in the structured sections 2 in order to keep the pressure drop of the tubeside flowing medium as low as possible. The outside and inside diameter of the tube 30 are at a given structure type in relation to one another in the structured section 2 so that also the outside diameter of the tube 30 should be as large as possible in the structured section 2. Thus, it is advantageous to choose the outside diameter in the structured section 2 to be almost equal to the outside diameter of the smooth tube sections 1*a* and 1*b*.

In order to lower the material costs of such tubes, the specific tube weight (i.e. tube weight per unit of length) of the tubes must be reduced at a specified tube diameter. Since the minimum wall thickness is limited by safety requirements, a reduction in the specific tube weight can only be achieved through a reduction of the weight of the structure. An increase of the heat-transfer surface through structuring with a simultaneous minimizing of the structure weight requires a very fine, slim structure.

The use of double enhanced tubes is state of the art in some parts of the industry (for example, in chillers for air conditioners). Many of these tubes are based on finned tubes, whereby the fin tips were modified through notching and flattening. Such tubes are usually manufactured using a rolling process: Rolling disks with a specific profile shape are set up with an increasing diameter on one or more tool shafts. These tool shafts are arranged evenly around the periphery of the tube to be worked. When the inclined positioned, rotating tool shafts are moved towards the smooth tube, the rotating rolling disks penetrate into the wall of the tube, rotate the tube, advance it corresponding to their inclined position in axial direction to form radially outwardly extending helical fins out of the wall of the tube. This operation is similar to a thread rolling operation. Examples for this technology are illustrated in U.S. Pat. Nos. 2,868,046, 3,327,512, 3,383,893 and 3,481,394.

The tube is during the rolling process supported by a mandrel lying in the tube, which mandrel absorbs the radial forces. In order to produce an inner structure, profiled mandrels are provided with helical grooves (DE 23 03 172 C2). Since the inner structure of the tube is determined by the profile shape of the mandrel, it can be shaped essentially independent from the geometry of the outer fin structure. Thus, it is possible to optimally adapt the outer and inner structure independent from one another to accommodate various operating conditions. The mandrel must rotate at a certain speed in order to unscrew itself from the inner structure of the tube. This produces high friction forces between the mandrel and the tube, which must be applied by the rolling disks in order to cause the advance of the tube in the axial direction. A considerable portion of these friction forces is directed parallel with respect to the tube axis 33 and thus also almost parallel with respect to the axis of the rolling disks.

It is known that it is advantageous for certain applications (for example, refrigerant evaporators and condensers) to use structures with small fin pitches in order to achieve an increase in the heat-transfer performance. In the past, fin pitches of 1.35 mm (19 fins per inch) have been used. Today finned tubes having fin pitches of approximately 0.40 mm are commercially available (U.S. Pat. No. 5,697,430 and DE-19757 526). EP-0 701 100 A1 shows that the trend is going to yet smaller pitches (0.25 mm).

Smaller fin pitches demand thinner rolling disks, which causes an increased danger regarding breakage due to the above mentioned friction forces and a greater susceptibility to wear of the tool. The tool life thus becomes more critical and repeated production interruptions because of tool exchange are the consequence. Furthermore the production speed of the rolling machines decreases with decreasing fin pitch. At the same time, because of worldwide competition, the production costs become a decisive factor for the economical success of the manufacture of structured tubes.

SUMMARY OF THE INVENTION

Therefore the basic purpose of the invention is to manufacture a delicately structured tube which has both on the outside and also on the inside a large increase in surface area and has a low structure weight. The geometries of outer and inner structures are adaptable independent from one another. The tube must be able to be manufactured at a high speed, with simple tools and low tool wear. Smooth end sections and intermediate sections are manufactured without extra expense.

The purpose is attained according to the invention by creating recesses with certain dimensions on the outside and ribs with certain dimensions on the inside of the tube. The recesses and ribs are formed by pressing rotating roll-forming tools into the tube wall and by the displaced material of the tube wall being pressed inwardly onto a profile mandrel lying in the tube. The utilized structuring tools can be adjusted in such a manner that they create both aligned, continuous grooves and also non-aligned, spaced-apart recesses.

By using additional tools, it is possible to modify the recesses so that secondary structures are created at the flanks or at the base of the recesses or at the ribs between the recesses. Depending on the use, these secondary structures can significantly increase the thermal performance of tubes. This occurs essentially by utilizing surface-tension effects.

It is advantageous for condenser tubes to create structures which have convex edges and channels extending essentially in peripheral direction. These channels enable the discharge of condensate, which is generated on the tube itself or on the tubes of the tube bundle being arranged thereabove.

It is advantageous for tubes, which are utilized in flooded evaporators or spray evaporators, to produce structures with cavities by partially closing off the upper areas of the recesses. This is achieved according to the invention by additional flattening tools which are arranged downstream of the primary structuring tool on the tool shaft.

BRIEF DESCRIPTION OF THE DRAWINGS

The invention will be discussed in greater detail hereinafter in connection with the following exemplary embodiments, in which.

DETAILED DESCRIPTION

Figure 1:
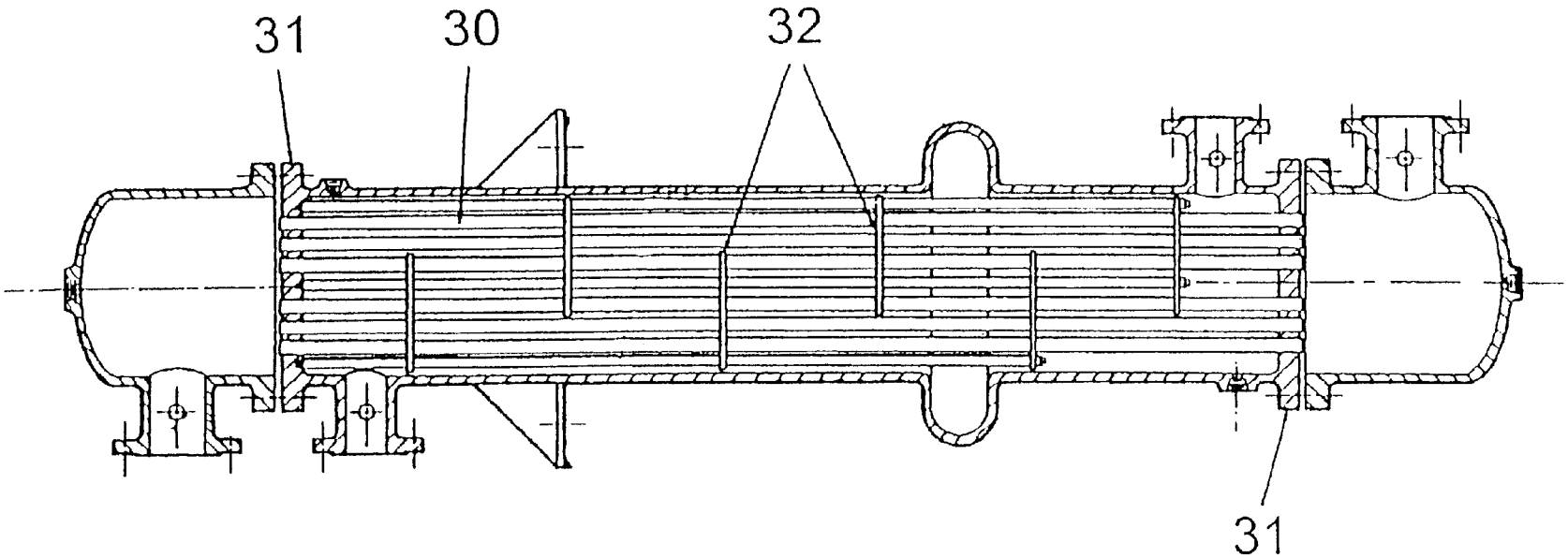
FIG. 1 (PRIOR ART)
FIGS. 1 and 2 are prior art illustrations.
Figure 2:
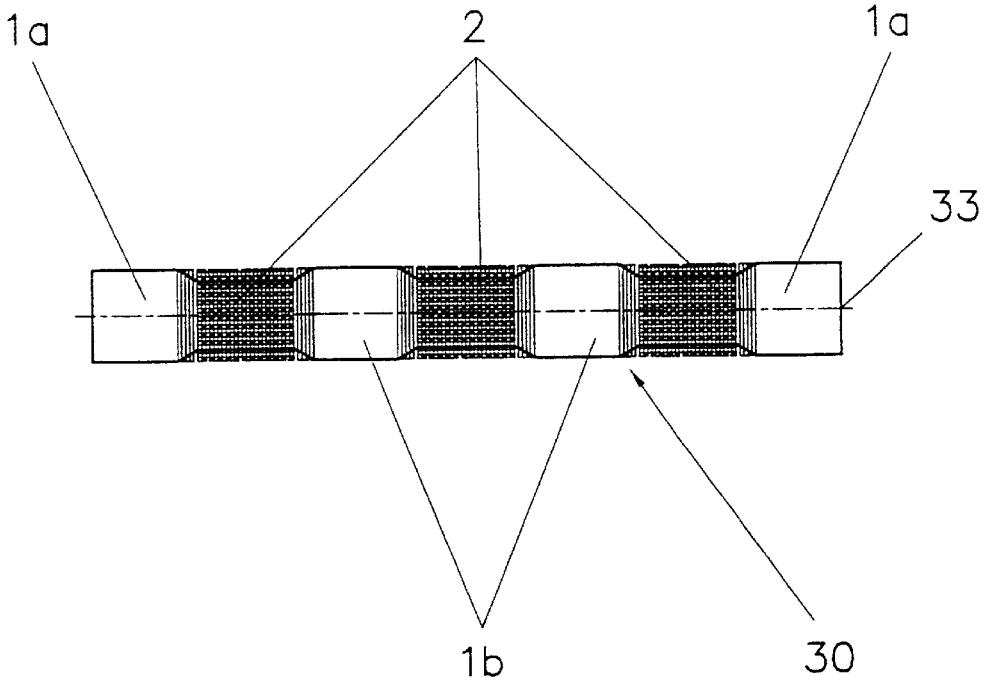
FIG. 2 (PRIOR ART)
Figure 3:
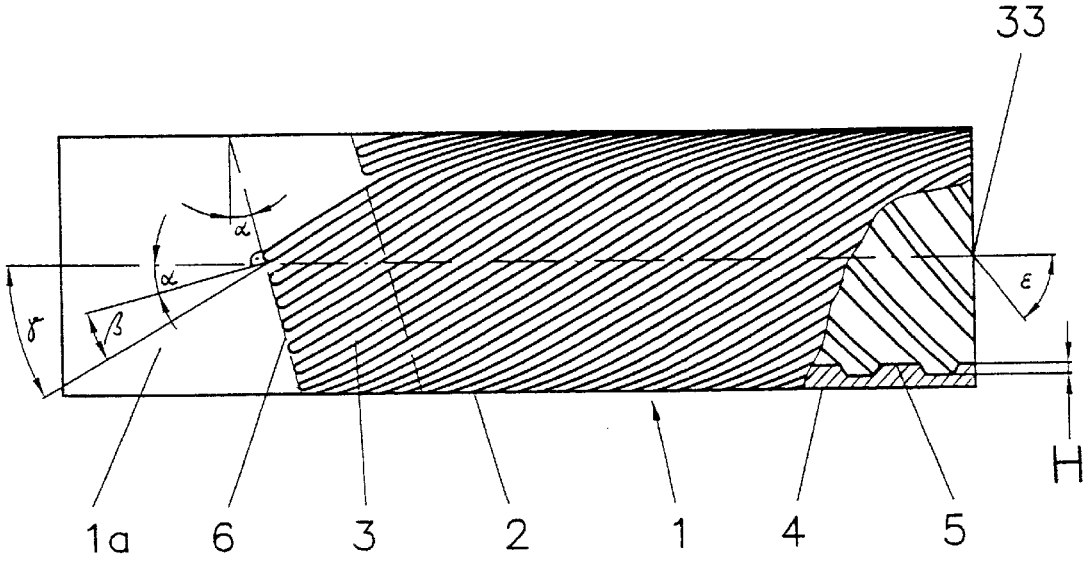
FIG. 3 illustrates a heat-exchanger tube 1 of the invention having a smooth end section 1*a,* a transition section in which the outer structure starts, and a structured section 2, whereby the recesses 3 are formed as continuous, aligned grooves.

A one-piece, metallic heat-exchanger tube 1 according to FIG. 3 has smooth end sections 1*a* and at least one structured section 2 on the outer and inner sides of the tube (a second smooth end section 1*a* and optional intermediate sections 1*b* are not illustrated). The structure 2 consists of aligned, continuous recesses 3 which extend helically around the tube 1. The starts 6 of the recesses 3 are on lines which are inclined at the inclined angle α with respect to the peripheral direction of the tube. The recesses 3 have been formed into the outer side of the tube by pressing one or more rotating roll-forming tools 10 into the wall of the tube 4 and by the so displaced material of the wall of the tube 4 being pressed radially inwardly. This decreases the inside diameter of the tube 1. The continuous recesses 3 are created by successively joining finite individual recesses which are aligned with one another and which are formed by the roll-forming tools 10. The outside diameter of the tube 1 may not be greater in the structured section 2 than in the smooth sections (end sections 1*a,* intermediate sections 1*b* ).

The tube 1 illustrated in FIG. 3 additionally has, in order to improve the heat transfer on the inside of the tube, helically extending, trapezoidal ribs 5 which have also been formed out of the material of the wall of the tube 4. The helix angle ϵ of the ribs 5 is measured relative to the tube axis 33 and is usually between 10° and 50° . The height H of the ribs 5 can be up to 0.60 mm. Larger rib heights are rather difficult to manufacture. A surface increase of up to 100% compared to a tube which is smooth on the inside is achieved with such an inside structure. Independent of the type of the inside structure usually a surface increase of at least 20% compared to a tube which is smooth on the inside is needed for a clear increase of the internal heat transfer.

Figure 4:
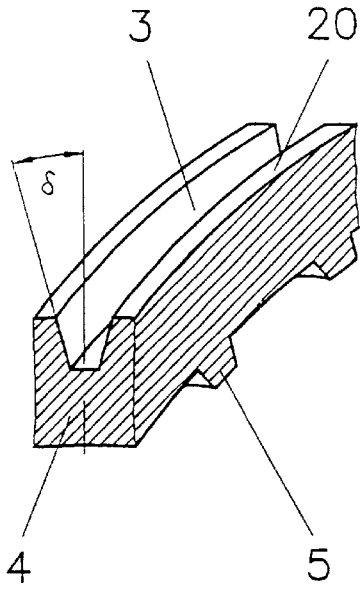
FIG. 4 is a detailed view of one single recess 3, whereby the flank angle δ of the recess 3 is measured relative to the plane of symmetry of the recess 3.

FIG. 4 illustrates a detailed view of one single continuous recess 3. The recesses 3 have an essentially trapezoidal cross section. The nonworked sections 20 between the recesses 3 are called ribs. The outside diameter of the tube—measured over these ribs 20—is usually almost equal to the outside diameter of the smooth sections 1*a,* 1*b.* The base of the channel 3 can have an angular, round, curved or other shape. This shape is determined by the shape of the elevations 13 of the roll-forming tool 10. The shape can be optimized so that the shaping process is done similar to the rolling movement of shape-optimized gears. The flank angle δ of the recess 3 is measured, as illustrated in FIG. 4, relative to the plane of symmetry of the recess 3.

Figure 5:
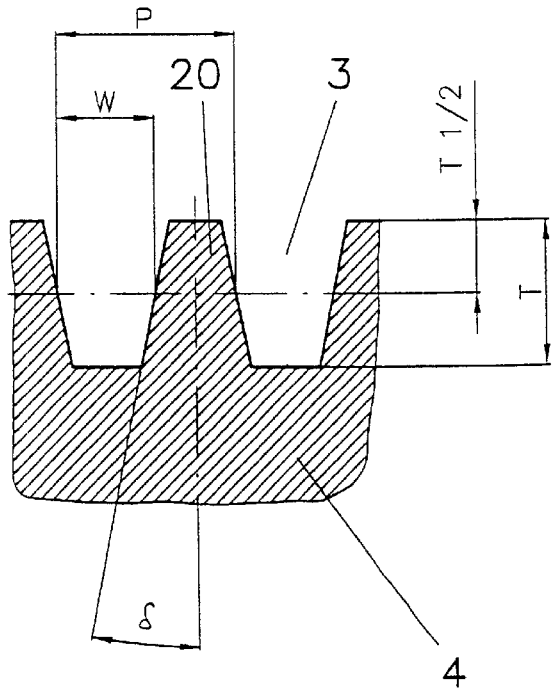
FIG. 5 is a cross-sectional view of the recess 3 perpendicular with respect to the longitudinal direction of the recess 3.

FIG. 5 illustrates a cross-sectional view of the recess 3 perpendicular with respect to the longitudinal direction of each recess 3. The dimensions of the recesses 3 are chosen such that an as large as possible outer surface is achieved. In particular, the flank angle δ as is small as possible, the depth T and the number of the recesses 3 on the periphery are as large as possible. A depth T of 0.4 mm to 1.5 mm can be achieved. The preferred range for the flank angle δ is between 7° and 25° . The pitch P of the recesses 3 is measured perpendicularly with respect to the plane of symmetry and is preferably 0.25 mm to 2.2 mm. The width W of the recesses 3 is measured at half depth T. The width W is 60% to 80% of the pitch P. Consequently, the volume of the recesses 3 is larger than the volume of the ribs 20, which causes a low weight of the structure.

Figure 6:
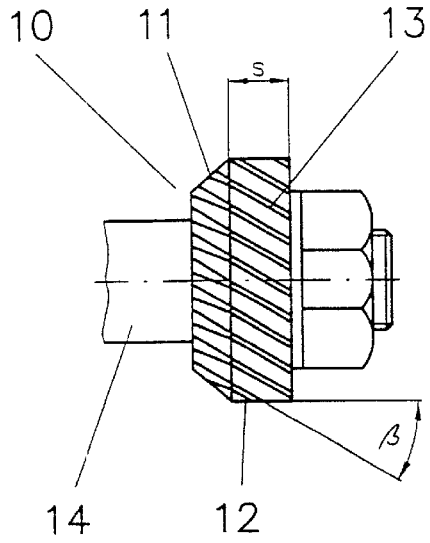
FIG. 6 illustrates the roll-forming tool 10 mounted on a tool shaft 14 for the creation of the outer structure illustrated in FIG. 3.

FIG. 6 illustrates a roll-forming tool 10, which is mounted on a tool shaft 14 and is designed to create aligned, continuous recesses. The roll-forming tool 10 has on its periphery a number of regular, trapezoidal elevations 13 similar to a gear. The elevations extend helically at a helix angle β measured relative to the axis of the tool 10. In order to keep the tool wear in the front working zone 11 of the tool 10 low, it is advantageous to provide the roll-forming tool 10 partially with a conical configuration thereat. It can furthermore be advantageous to supplement the structured cone 11 of the roll-forming tool 10 with a smooth conical section. The cylindrical part 12 of the roll-forming tool 10 has the thickness s. The production machines have usually three or four tool shafts 14 which are arranged evenly spaced around the periphery of the tube, such as in an equilateral triangle or square array. The tool shafts 14 are during the working process positioned inclined with respect to the axis of the tube 33. The skew angle α is inherently equal to the angle α which the lines, on which lie the starts 6 of the recesses 3, define with the peripheral direction of the tube, as is shown in FIG. 3.

Figure 7:
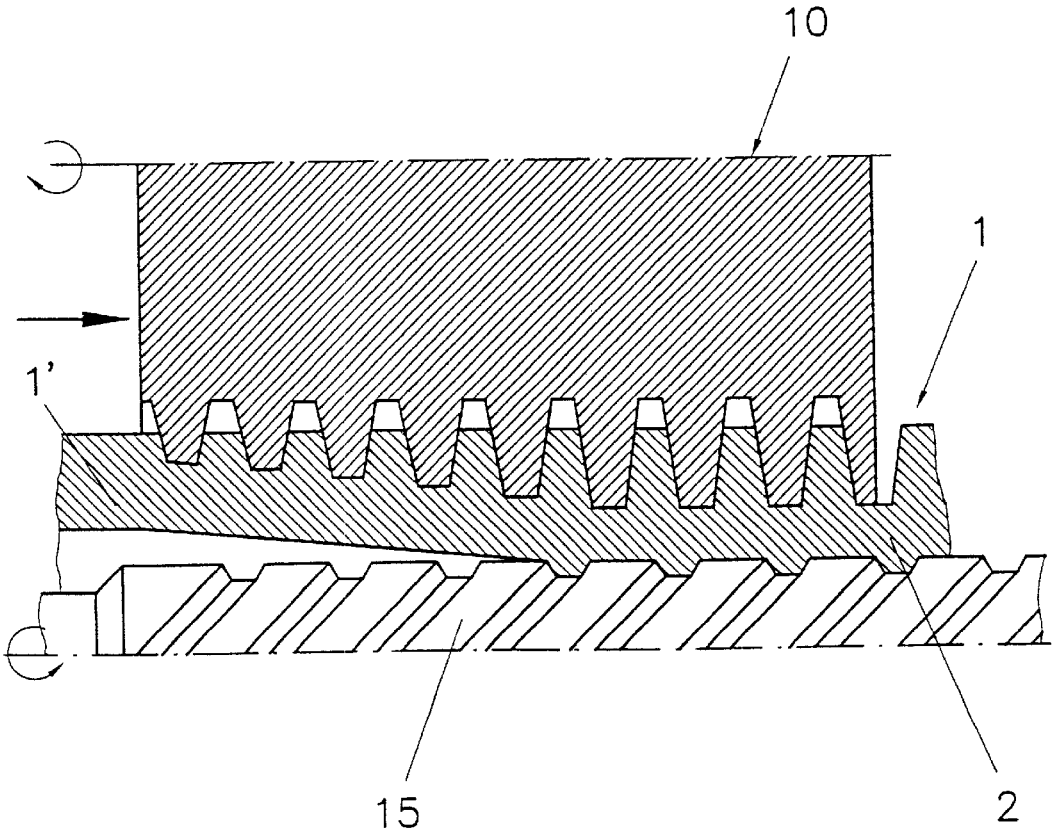
FIG. 7 schematically illustrates the structuring process.

The structuring process is schematically illustrated in FIG. 7. Tube and roll-forming tool 10 are hereby illustrated in a longitudinal cross-sectional view. A smooth tube 1' is rotated by the rotating roll-forming tool 10 and is advanced in an axial direction corresponding to the inclined position of the tool. The direction of movement of the tube in axial direction is indicated by an arrow. When the smooth tube 1' enters the shaping zone under the roll-forming tool 10, recesses 3 are formed on the outside of the tube and the inside diameter is reduced. The material of the wall of the tube 4 is pressed onto the profiled mandrel 15 lying inside of the tube. The mandrel 15 is supported rotatably in order to adapt to the rotation of the tube. The remaining wall thickness of the tube is in the structured section 2 (measured between outer and inside structure) necessarily less than the wall thickness of the smooth tube 1' since both the inside and also the outer structure are formed out of the wall material of the smooth tube 1'.

It must be ensured that the individual recesses formed by each roll-forming tool 10 are arranged aligned with one another in order to create through a successive joining of finite individual recesses continuous grooves 3. This is achieved by adjusting the skew angle α to the pitch P of the recesses 3, the number $n_R$ of the recesses 3 on the periphery of the tube, the core diameter $D_{core}$ of the tube 1 (measured at the base of the recesses 3) and the helix angle β of the roll-forming tool 10 according to the following equation:

$$a = \arccos\left(\frac{P \cdot n_R}{\pi \cdot D_{core}}\right) - \beta \qquad \text{(equation 1)}$$

Furthermore the thickness s of the cylindrical part 12 of the roll-forming tool 10 must have the following minimum dimension in order for the recesses 3 to continue without interruption:

$$s \geq \frac{1}{m} \cdot \pi \cdot D_{core} \cdot \sin(a) \qquad \text{(equation 2)}$$

wherein m is hereby the number of the tool shafts 14 arranged around the tube.

The pitch angle γ of the recesses 3 is measured relative to the tube axis 33 and equals the sum of the skew angle α and the helix angle β of the roll-forming tool, as is illustrated in FIG. 3. γ lies in the range between 0° and 70°.

In order to maximize the speed of the structuring process, it is advantageous to choose the skew angle α of the tool 10 as large as possible. In order to meet the abovementioned equation 1, the helix angle β of the roll-forming tool 10 can be adjusted at a specified structure geometry. In practice, it is possible to achieve, when using the described method, skew angles α of between 5° and 15° . Larger skew angles would permit even higher production speeds. Structured tubes, which are manufactured according to U.S. Pat. No. 5,697,430 or DE-197 57 526 according to the common finning method, require at a fin pitch of approximately 0.4 mm, depending on the number of utilized tool shafts 14 and depending on the tube diameter, typically skew angles α of between 1.5° and 2.5° . This shows the advantage of the inventive manufacturing method regarding the production speed.

Smooth intermediate section 1*b* can be produced optionally by disengaging the roll-forming tools 10 from the smooth tube 1' (compare, for example, DE-A 1 452 247).

Figure 8:
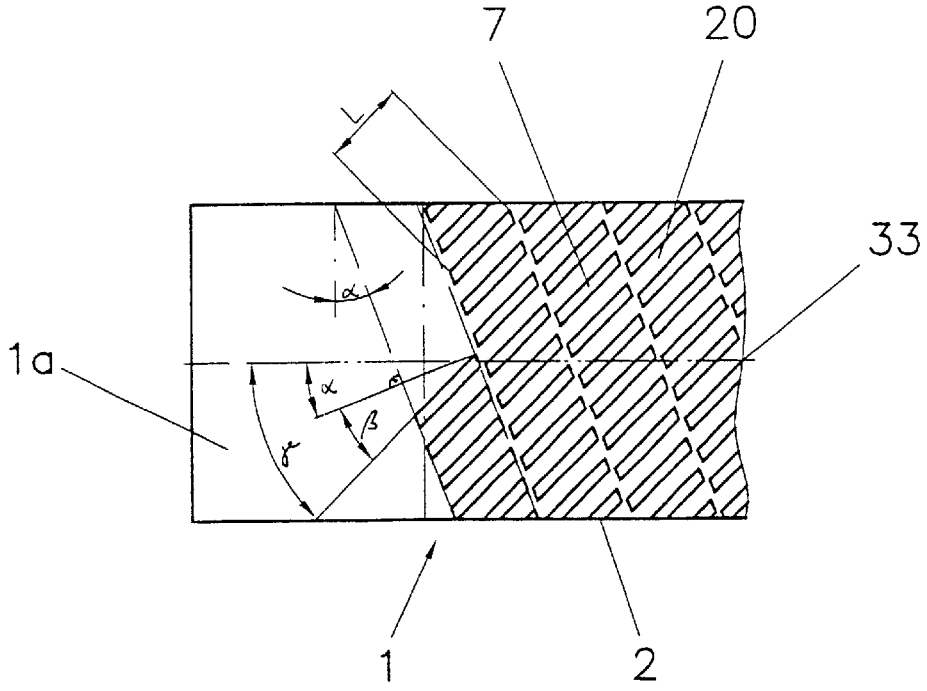
FIG. 8 schematically illustrates a tube section with a smooth section 1*a,* a transition section in which the outer structure starts, and a structured section 2, whereby the recesses 7 are spaced apart so that they form individual, non-aligned depressions 7.

FIG. 8 illustrates schematically an inventive structured tube 1 with spaced-apart, non-aligned recesses 7. The recesses 7 have the length L. The transition area between the smooth end section 1*a* and the structured section 2 is illustrated. The recesses 7 are arranged in separated rows which extend helically around the tube 1. Such a row is called a "track". Each roll-forming tool 10 arranged around the tube 1 creates a separate track. In order to maximize surface gain, the adjacent tracks are arranged as close as possible.

The spaced-apart recesses 7 illustrated in FIG. 8 are formed by using a roll-forming tool 10 without the conical working part 11. The roll-forming tool 10 consists only of a cylindrical part 12 having the thickness s. The finite length L of the spaced-apart recesses 7 depends on the thickness s of the roll-forming tool 10 and the helix angle β of the elevations 13 on the roll-forming tool 10 as follows:

$$L = s/\cos\beta \qquad \text{(equation 3)}$$

In order to prevent that the tracks of the individual roll-forming tools 10 overlap, the skew angle α must be suitably chosen:

$$a > \arcsin\left(\frac{s \cdot m}{D_{core} \cdot \pi}\right) \qquad \text{(equation 4)}$$

wherein m is the number of the tool shafts 14 arranged around the tube 1 and $D_{core}$ the core diameter of the tube 1. In case the skew angle α is limited upwardly for design reasons, the maximum thickness of the roll-forming tool 10 is determined by the following equation:

$$s < \frac{1}{m} \cdot \pi \cdot D_{core} \cdot \sin(a) \qquad \text{(equation 5)}$$

Figure 9:
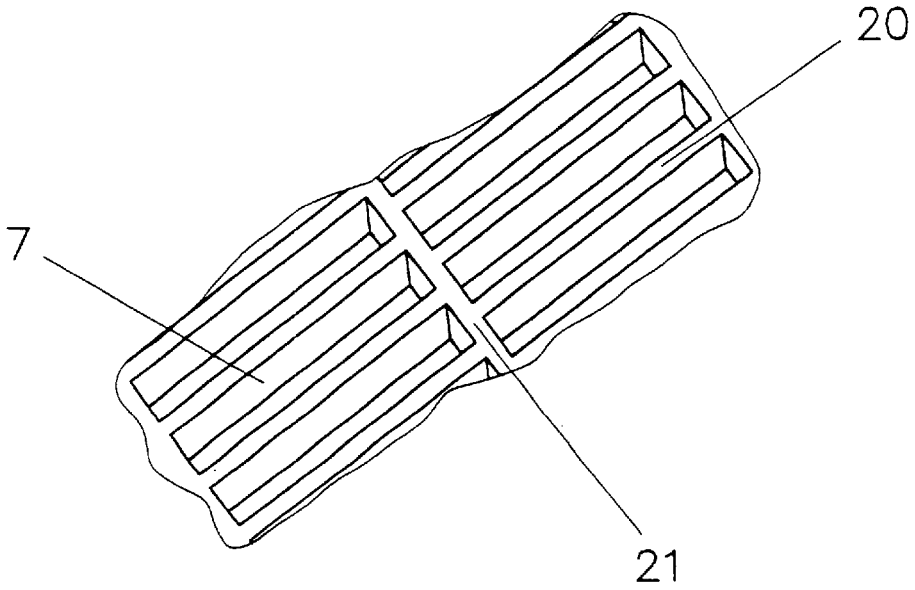
FIG. 9 is an enlarged view of six spaced-apart, non-aligned recesses 7.

FIG. 9 illustrates an enlarged view of the spaced-apart, non-aligned recesses 7 of FIG. 8. Adjacent recesses 7 of a track are separated by ribs 20. A thin tube section 21 between adjacent tracks remains unformed. Measured over the unformed sections 21 and ribs 20, the tube 1 has almost the same outside diameter as the smooth sections 1*a*, 1*b*. The recesses 7 have essentially a trapezoidal cross section. The base of the recess 7 can have an angular, round, curved or other shape. This shape is determined by the shape of the elevations 13 of the roll-forming tool 10.

The cross-sectional view of the spaced-apart recesses 7 is identical with the cross-sectional view of the aligned, continuous recesses 3 illustrated in FIG. 5. The geometric dimensions of the recesses 7 are in the same range for the case of the spaced apart recesses 7 as in the case of the aligned, continuous recesses 3. In particular, the relationships mentioned in connection with FIG. 5 are valid. Thus, both cases result in similar advantageous characteristics of the tube 1 with respect to the surface gain and structure weight.

Figure 10:
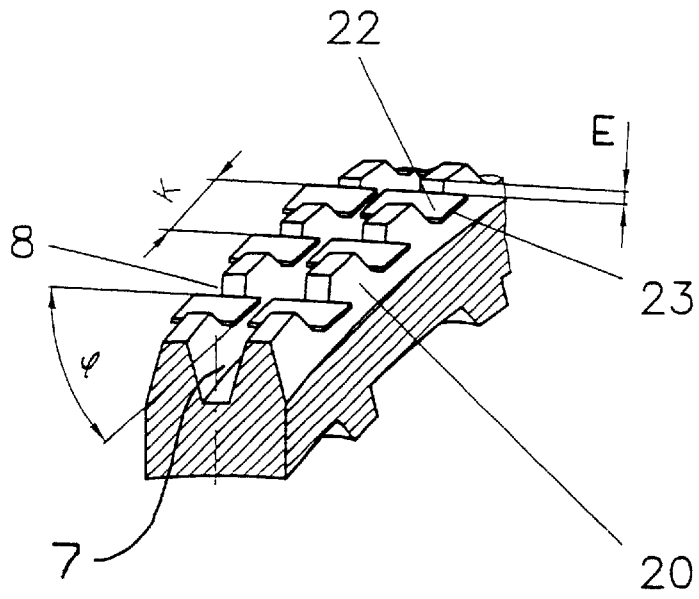
FIG. 10 is a detailed view of a recess 3 having secondary grooves 8 in the ribs 20, whereby the secondary grooves 8 are arranged transversely with respect to the primarily formed recesses 3.
Figure 11:
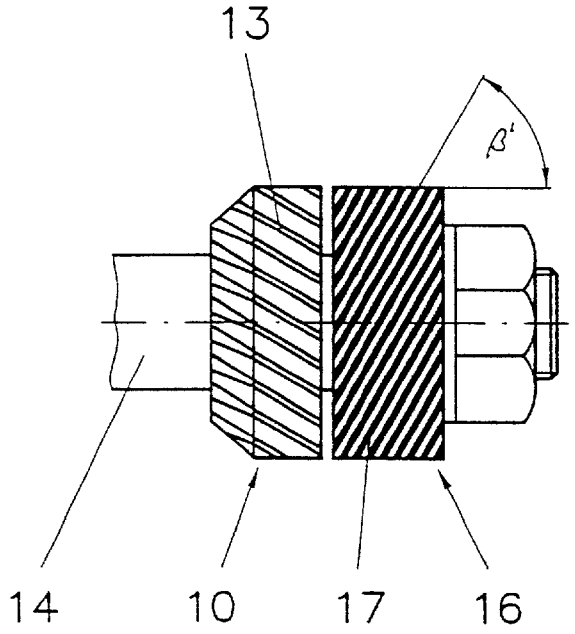
FIG. 11 is a total view of the design of the tool for the creation of the outer structure which is illustrated in FIG. 10.

The heat transfer performance of the heat-exchanger tube 1 of the invention can be further increased by utilizing surface-tension effects. It is known that with tubes for condensers, convex edges result in thinning of the condensate film. The density of the convex edges is significantly increased by secondary grooves 8 which are embossed essentially transversely with respect to the primarily formed recesses 3, 7. A structure modified in this manner is illustrated in an enlarged manner in FIG. 10. The material of the rib 20 displaced by impressing the secondary grooves 8 forms projections 22 which are arranged essentially transversely with respect to the primarily formed recesses 3, 7. The edges 23 of these projections 22 represent a part of the desired, additional convex edges. The tool set-up, which is used to create the structure of FIG. 10, is illustrated in FIG. 11 and consists of a primary roll-forming tool 10 and a secondary notching disk 16, which are arranged spaced from one another on the tool shafts 14. The secondary notching disk 16 has on its periphery a number of regular elevations 17 similar to a gear. The elevations 17 extend helically at a helix angle of β' measured relative to the axis of the notching disk 16. The depth E of the secondary grooves 8 should be 20% to 80% of the depth T of the primary recesses 3, 7. Accordingly, the diameter of the notching disk 16 is chosen smaller than the diameter of the roll-forming tool 10. The pitch should be K=0.25 to 2.2 mm. The angle ϕ, which the primary recesses 3, 7 define with the secondary grooves 8, is determined by the helix angle β of the elevations 12 of the roll-forming tool 10 and the helix angle β' of the elevations 17 of the notching disk 16. ϕ can be between 20° and 160°.

It is an inherent advantage of the invention that the main shaping step, during which, as it is illustrated in FIG. 7, the primary outer structure and the inside structure are simultaneously formed, can be carried out by a relatively rough roll-forming tool 10. The secondary structure, which is usually much more delicate than the primary one, is not formed out of the tube wall 4 but instead out of the fins 20. This means that the amount of material to be shaped during the fine-structuring step is much less than in common manufacturing methods, where delicate fins are formed with delicate tools directly out of the massive tube wall. This is advantageous for the life of the tool.

A modified structure is obtained by producing the secondary grooves 8 by means of a number of thin rolling disks (not illustrated) having a constant diameter, whereby the rolling disks are assembled as a package instead of the secondary notching disk 16 after the roll-forming tool 10 on the tool shaft 14. The direction of the secondary grooves 8 is in this case parallel to the perpendicular to the axis of the tool shaft 14. Since the skew angle α is approximately 10°, these secondary grooves 8 are thus inclined only at this relatively small angle relative to the vertical with respect to the tube axis 33. Such secondary grooves 8 have the advantage in a horizontal tube arrangement that condensate dripping down from above can be discharged easily downwardly by gravity like in almost vertical channels.

It is known that the process of the nucleate boiling can be clearly intensified when undercut, cavity-like structures are formed on the surface of the tube. These cavities or also tunnels are connected through openings or pores to the surrounding fluid ("undercut" means in this connection that the opening of the cavities is smaller than the cavity lying therebelow). The significant portion of the evaporation takes place in these cavities or tunnels. Liquid penetrates through the pores into the cavities. The generated vapor escapes through the pores.

Undercut caverns or tunnels are created according to the invention by partially closing off the upper area of the recesses 3, 7.

Figure 12:
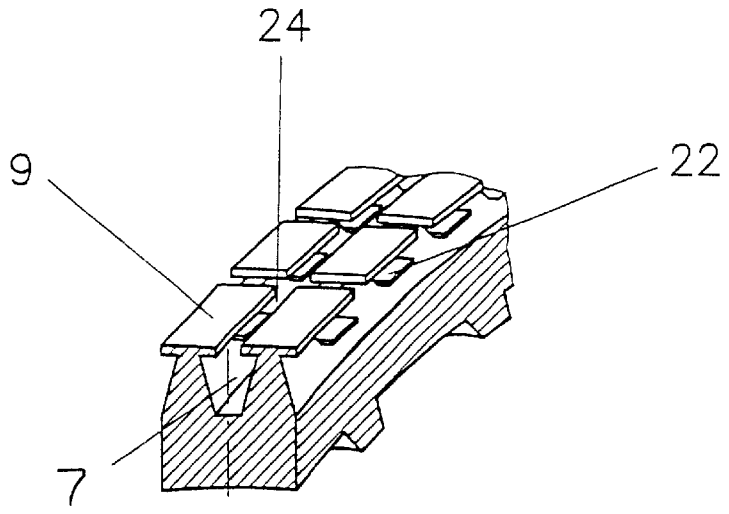
FIG. 12 is a detailed view of a structured tube 1, in which the outer periphery 9 of the ribs 20 have been flattened in order to create cavity-like channels beneath the outer surface.
Figure 13:
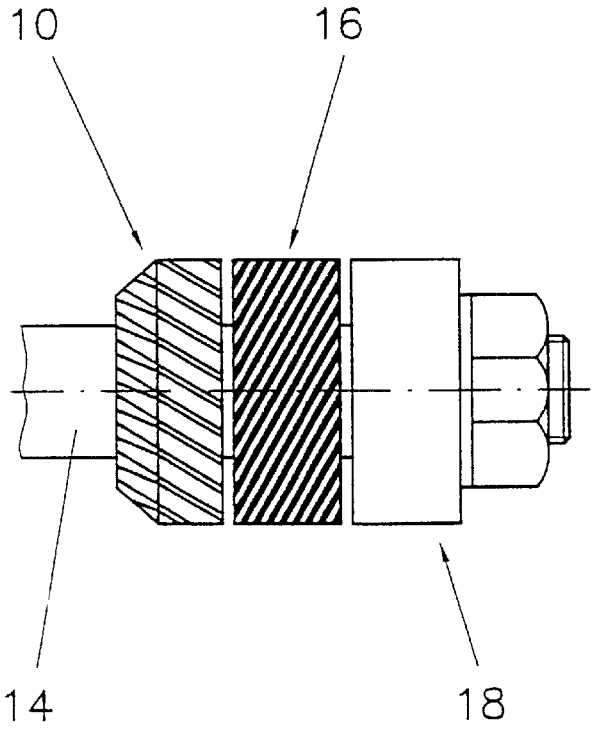
FIG. 13 is a total view of the design of the tool for the creation of the outer structure which is illustrated in FIG. 12.

FIG. 12 is an enlarged view of a section of a structured tube 1, where the periphery of adjacent ribs 20 provided with secondary grooves 8 are flattened. The flattened segments 9 form a partially closed lid over the recess 3. A system of cavities lying under the outer surface of the tube, which cavities are connected to the surrounds through narrow openings 24, are created in this manner. It is advantageous to use a smaller pitch for the secondary grooves 8 than for the primary recesses. FIG. 13 shows a tool set-up for the creation of such structures. A cylindrical flattening disk 18 having a constant diameter is arranged on the tool shaft 14 downstream of the notching disk 16. The diameter of the flattening disk 18 is less than the diameter of the roll-forming tool 10.

Similar structures are obtained by partially closing off non-aligned, spaced-apart recesses 7.

The closing of the recesses 3, 7 causes a reduction of the outer tube diameter. This, however, can be controlled by controlling the primary structuring step in such a manner that not all material displaced on the outside of the tube is needed on the inside of the tube to form the inside structure. A roll-forming tool 10 with a great displacement and a profiled mandrel 15 with narrow grooves is utilized for this purpose. Furthermore the diameter of the mandrel must be chosen suitably. The ribs 20 between the recesses 3, 7 are then shaped outwardly in radial direction, which, compared to the smooth tube 1', results meanwhile in a larger tube diameter in this tube area. The secondary grooves 8 are subsequently formed and the resulting segments 9 of the ribs 20 are flattened in order to partially close off the recesses 3, 7. When the method parameters are chosen as illustrated, then the final outside diameter in the structured section 2 can be less or equal to the outside diameter on the non-worked, smooth end sections 1*a*.

The proceeding paragraphs show the great flexibility of the suggested engineering to create heat-transfer-increasing structures on surfaces of tubes. The method can be applied both to seamless, drawn tubes and also to welded tubes, which were manufactured of formed-in metal strips. The suggested tubes and methods, however, are always based on the structuring of tubes and not of strips.

NUMERICAL EXAMPLE

According to the described method, copper tubes 1 structured on both sides were manufactured with a core diameter $D_{core}$ of 17.80 mm. The outer structure consists of 36 aligned, continuous recesses 3. The following geometric data were the basis for the roll-forming tool 10:

Flank angle δ: 10°
Helix angle β: 57°
Pitch P : 0.67 mm
Width W : 0.40 mm

The skew angle α of the tool shafts 14 has to be adjusted to 7.5°. Accordingly the pitch angle γ of the grooves is 64.5°. The depth T of the recesses 3 is 0.7 mm. The inside structure consists of 41 trapezoidal-shaped ribs 5, which are helically oriented at a pitch angle ϵ of 45°. The height H of the inner ribs 5 is 0.35 mm. The secondary grooves 8 were created with a package of rolling disks with the pitch 0.35 mm. The thus created tube structure shows, when condensing the refrigerant HFC-134*a* on the outside and cooling-water flow on the inside of the tube, good heat-transfer performance.

Depending on the physical characteristics of the fluid, the pitch K of the secondary grooves 8 should lie between 0.25 mm and 2.2 mm.

What is claimed is:

1. A heat-exchanger tube with smooth end sections and at least one structured section between the end sections, whereby an outside diameter of the structured section is no greater than an outside diameter of the smooth end sections, the structural section having the following characteristics:

a) spaced-apart recesses having an essentially trapezoidal cross section with a length L of a maximum of 10% of the circumference of the tube inclined on the outside of the tube at a pitch angle with respect to the tube axis;

b) the pitch P of the recesses being from 0.25 mm to 2.2 mm, measured perpendicularly with respect to their plane of symmetry;

c) the width W of the recesses being W=0.6 P to 0.8 P, measured at half the depth T of the recesses;

d) the flank angle δ of the recesses being δ=7° to 25°, measured relative to their plane of symmetry; and e) inner ribs with a height H from 0.15 mm to 0.60 mm extending helically on the inside of the tube at a helix angle E from 10° to 50°, measured relative to the tube axis.

2. The heat-exchanger tube according to claim 1, wherein the length L of the spaced-apart recesses is from 1 mm to 4 mm.

3. The heat-exchanger tube according to claim 1, wherein the depth T of the recesses is from 0.4 mm to 1.5 mm.

4. The heat-exchanger tube according to claim 1, wherein the pitch angle γ of the recesses is from 15° to 60°.

5. The heat-exchanger tube according to claim 1, wherein the flank angle δ of the recesses is from 9° to 15°.

6. The heat-exchanger tube according to claim 1, wherein the ribs on the inside of the tube have an essentially trapezoidal cross section.

7. A method for manufacturing the heat-exchanger tube according to claim 1, comprising the following method steps:

a) forming spaced apart recesses inclined with respect to the tube axis on the outside of a smooth tube by displacing material of the tube wall radially inwardly by means of roll-forming tools to form the ribs extending helically on the inside of the tube, whereby b) the roll-forming tools are arranged around the periphery of the tube, c) the roll-forming tools are cylindrical, and use trapezoidal elevations which extend helically with respect to the tool axis at a helix angle β, d) tool shafts of the roll-forming tools are positioned inclined with respect to the tube axis at a skew angle α, e) the thickness s of the cylindrical roll-forming tools is selected according to the following equation:

$$s < \frac{1}{m} \cdot \pi \cdot D_{core} \cdot \sin(a)$$

with:

m=the number of the tool shafts arranged around the tube, $D_{core}$=the core diameter of the tube, measured at the base of the recesses, f) the roll-forming tools engage in a shaping zone the smooth tube, which causes the tube to rotate and advance in an axial direction corresponding to the inclined position of the roll-forming tools, and g) the tube wall in the shaping zone is supported by a rotating, profiled mandrel lying in the tube.

8. The heat-exchanger tube according to claim 2, wherein secondary grooves extend over the outside of the tube transversely with respect to the recesses at a notch angle ϕ from 20° to 160°.

9. The heat-exchanger tube according to claim 8, wherein the notch angle ϕ is between 30° and 150°.

10. The heat-exchanger tube according to claim 8, wherein the depth E of the secondary grooves is in the range of 0.2 T to 0.8 T of the depth of the recesses.

11. The heat-exchanger tube according to claim 8, wherein the pitch K of the secondary grooves is in the range of 0.25 to 2.2 mm.

12. The heat-exchanger tube according to claim 8, wherein the recesses define outer ribs therebetween, and the periphery of the outer ribs between the recesses are flattened.

13. The method according to claim 7, wherein secondary grooves extend over the outside of the tube, transversely with respect to the recesses at a notch angle ϕ from 20° to 160°, and wherein a periphery of outer ribs between the recesses are pressed in sections by a notching disk.

14. The method according to claim 7, wherein second grooves extend over the outside of the tube transversely with respect to the recesses at a notch angle ϕ from 20° to 160°, and wherein a periphery of outer ribs between the recesses are pressed in sections by rolling disks.

15. The method according to claim 13, wherein the periphery of the outer ribs between the recesses are flattened by a flattening disk.

* * * * *